United States Patent [19]

Morris et al.

[11] Patent Number: 4,918,355

[45] Date of Patent: Apr. 17, 1990

[54] ELECTRIC LAMP WITH PROTECTIVE BASE

[75] Inventors: Merle E. Morris; Stephen P. Senft, both of Lexington, Ky.

[73] Assignee: GTE Products Corporation, Danvers, Mass.

[21] Appl. No.: 926,826

[22] Filed: Nov. 3, 1986

Related U.S. Application Data

[63] Continuation of Ser. No. 718,309, Apr. 1, 1985, abandoned.

[51] Int. Cl.[4] ..... H01K 1/24; H01K 1/46

[52] U.S. Cl. ..... 313/318; 313/287; 313/331

[58] Field of Search ..... 313/318, 287, 274, 331; 339/144 R, 144 T, 145 T

[56] References Cited

U.S. PATENT DOCUMENTS

| | | | |
|---|---|---|---|
| 3,001,096 | 9/1961 | Mosby | 313/318 |
| 3,001,097 | 9/1961 | Smialek | 313/318 |
| 3,274,426 | 9/1966 | Scoledge et al. | 313/318 |
| 3,448,320 | 6/1969 | Millikan | 313/318 |
| 3,868,529 | 2/1975 | Walsh | 313/318 |
| 4,442,374 | 4/1984 | Morris et al. | 313/1 |

*Primary Examiner*—Kenneth Wieder

*Attorney, Agent, or Firm*—Lawrence R. Fraley; Owen J. Meegan

[57] ABSTRACT

An electric lamp (e.g., tungsten halogen) including an elongated envelope with at least one sealed end portion of flattened configuration. Located on the sealed end portion is a conductive base member of hollow configuration which is electrically coupled to the lamp's lead-in conductor (which projects externally from the envelope) and which is located not only substantially about the sealed end portion so as to substantially surround the end but also extends over a part of the envelope's body portion to thereby substantially prevent breakage of the sealed end portion (e.g., during lamp insertion and/or removal).

12 Claims, 1 Drawing Sheet

ELECTRIC LAMP WITH PROTECTIVE BASE

This application is a continuation of application Ser. No. 718309, filed Apr. 1, 1985, abandoned.

TECHNICAL FIELD

This invention relates to electric lamps and particularly to electric lamps having elongated, tubular envelopes and sealed (e.g., press-sealed) end portions at each end thereof. Even more particularly, the invention relates to lamps of this variety which include a tungsten filament therein and which are designed for use as a heat source.

BACKGROUND

The use of lamps of the above variety as heat sources is known. For example, extensive use has been made of tungsten halogen lamps (those containing a halogen within the envelope as part of the atmosphere thereof) by the reprographic industry, particularly in photocopy machines of the direct electrostatic type. Tungsten halogen lamps provide the basic advantages of fast warm-up, compact size and high energy loading, high color temperature and constant lumen maintenance. Lamps of this type have also been successfully utilized in such heating requirements as annealing, brazing, curing of protective coatings, and the drying of paints and adhesives. As indicated, such lamps have proven to be excellent heat sources for supplying relatively instant, concentrated radiant heat. This is due, primarily, to the fact that approximately seventy percent of the radiant energy emitted by these lamps is infrared.

When used in a typical photocoy machine, such a heat producing lamp is also referred to as a fusing lamp and is particularly designed to "set" the toner utilized by the machine.

Lamps of the above type typically include, in addition to the aforementioned tubular envelope, a base member on each end of the envelope. Examples of such bases are illustrated in U.S. Pat. Nos. 3,001,096 (Mosby); 3,001,097 (Smialek); 3,274,426 (Scoledge et al); and 4,442,374 (Morris et al). As described therein, the bases for these lamps typically are of relatively small construction (relative to the envelope) and are positioned on a relatively small portion of the envelope's press-sealed end portions. Such bases may be of a ceramic or similar material (i.e., as in U.S. Pat. No. 3,001,096) and provide connection to the lamp's external lead wire through some form of conductive cap (or contact) secured to the base.

Lamps of the above variety have typically possessed one or more of the following disadvantages: (1) poor electrical connection between the lamp and the respective power source (these lamps typically being positioned within a connector or socket which in turn is coupled to the source); (2) the need for relatively expensive connectors or sockets needed to accommodate the lamp; and (3) failure to adequately protect the seal area (at the envelope's ends) against breakage during handling and during operation (insertion and/or removal). The last mentioned disadvantage is particularly significant when considering the relatively delicate nature of lamps of the infrared type which include the aforementioned elongated, tubular glass envelope which, in some examples, may reach approximately forty inches in length and have an outer diameter of only about 0.375 inch.

It is believed, therefore, that an electric lamp which overcomes the several disadvantages mentioned above would constitute a significant advancement in the art. It is further believed that a lamp possessing such capability and which can be produced in both a relatively inexpensive and facile manner would constitute an even further advancement in the art.

DISCLOSURE OF THE INVENTION

It is a primary object of the present invention to enhance the electric lamp art.

It is another object of the invention to provide an electric lamp, and particularly one having an elongated envelope and base members secured thereto, which overcomes the several aforementioned disadvantages of many prior art lamps.

These and other objects are accomplished by the provision of an electric lamp including an envelope having an elongated body portion with at least one sealed end portion of flattened configuration located at one end of the body portion, a conductive filament located within the body portion of the envelope, at least one lead-in conductor positioned within the sealed end portion and connected at one end to the filament and having a second end projecting externally of the sealed end portion, and a base secured to the sealed end portion wherein the base is electrically conductive and of hollow configuration such that the base is located substantially about the sealed end portion of the envelope and a part of the envelope's body portion. The base is electrically coupled to the lead-in conductor and, because it extends over part of the envelope's body portion, serves to substantially prevent breakage of the lamp's sealed end portion.

BEST MODE FOR CARRYING OUT THE INVENTION

For a better understanding of the present invention, together with other and further objects, advantages and capabilities thereof, reference is made of the following disclosure and appended claims in connection with the above-described drawings.

Figure 1:
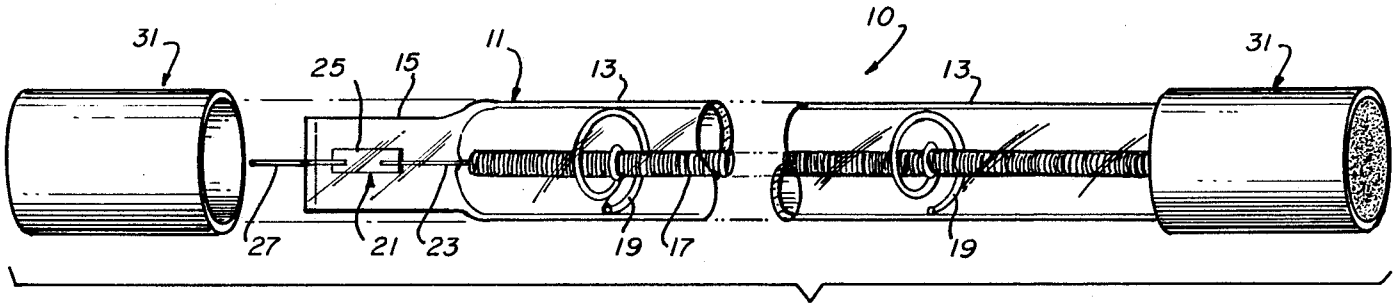
FIG. 1 is a side elevational view of an electric lamp in accordance with one embodiment of the present invention, illustrating one of the lamp's bases fully positioned on the end portion of the lamp's envelope and the other base slightly separated therefrom.

With particular attention to FIG. 1, there is illustrated an electric lamp 10 in accordance with a preferred embodiment of the invention. Lamp 10 includes an elongated, tubular envelope 11 having a substantially cylindrical body portion 13 and at least one sealed (e.g., press-sealed) end portion 15 located at the end of body portion 13. Lamp 10 preferably includes two sealed end portions 15, one at each respective end of the envelope's body portion. The sealed end located to the right in FIG. 1 is not shown for illustrative purposes. Each sealed end is preferably formed to the flattened configuration illustrated (see also FIG. 2) utilizing a press-sealing operation known in the art. End portion 15 in FIG. 2 is rotated about ninety degrees from the orientation depicted in FIG. 1

Located within body portion 13 of envelope 11 is a coiled filament 17 which is preferably centrally disposed therein. Filament 17 is preferably of coiled tungsten material and is maintained in such orientation through the use of at least one (and preferably several) looped wire support members 19. These are also referred to in the art as wire spacers and, in one embodiment of the invention, were comprised of tungsten material. Envelope 11 is of vitreous material (e.g., quartz or "Vycor," the latter being a trademark of the Corning Glass Works, Corning, New York for a glass having about ninety-eight percent silica content).

Each end of the longitudinal tungsten filament 17 is electrically connected to a lead-in conductor 21 which, as illustrated, pass through a respective one of the sealed end portions 15. In one embodiment of the invention, each lead-in conductor included an internally projecting wire 23 which is connected (e.g. welded) to filament 17, a thin ribbon 25 (e.g., molybdenum), and an outer or externally projecting wire 27 which, as illustrated, extends beyond sealed end 15. The inner wire 23 is preferably of tungsten material and the outer, externally projecting wire 27 may be of molybdenum, platinum, platinized molybdenum, or other suitable conductor material. Each wire 23 and 27 is connected to the molybdenum ribbon 25 by welding, after which wire 23 is secured to the respective end of filament 17. This entire conductor assembly is inserted within the cylindrical glass tubing which eventually forms envelope 11 and the respective sealed end portions are formed. Prior to sealing of one of these ends, the appropriate atmosphere(s) is introduced. In one example, the atmosphere within envelope 11 contained a halogen (e.g. the atmosphre within envelope 11 contained a halogen (e.g., bromine), an atmosphere known in the art. It is understood, however, that the teachings of the invention are not limited to lamps of the tungsten halogen variety. Accordingly, envelope 11 can be a non-halogen lamp wherein only an inert gas (e.g., argon) is utilized.

Figure 2:
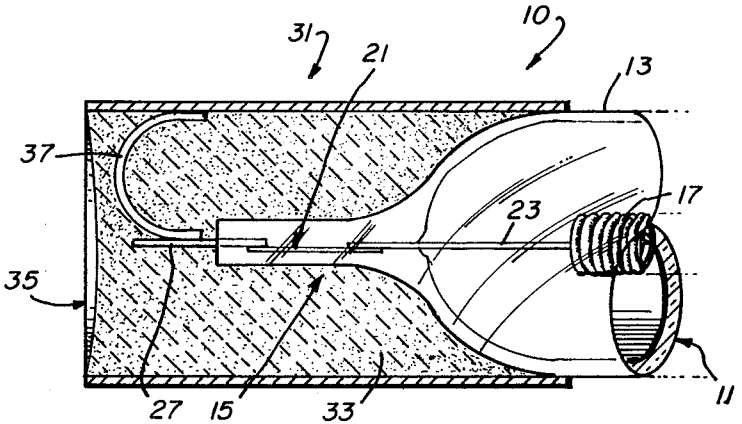
FIG. 2 is an enlarged, side elevational view, partly in section, illustrating the base of the invention as located on the invention's envelope.

In accordance with the teachings of the invention, lamp 10 includes at least one electrically conductive base 31 which is secured to the respective sealed end portion 15 in the manner depicted in FIG. 2. As shown in FIG. 1, two such bases are preferably utilized, one for each of the envelope's sealed end portions. Because both bases 31 are similar, it is understood that the description of the singular base illustrated in FIG. 2 will similarly apply to the other, non-illustrated base.

Base 31 is of a sound electrically conductive material (e.g., copper, aluminum, steel, nickel) and, as illustrated, is of hollow configuration. Accordingly, base 31 is designed for being positioned on at least a part of the cylindrical body portion 13. As also illustrated, base 31 projects well beyond the outermost edge of sealed end portion 15 so as to substantially totally surround this part of envelope 11. Base 31 is secured to envelope 11 using a quantity of refractory, sealing cement 33. The cement known in the art as Sauereisen has proven especially effective for this purpose. To facilitate the aforementioned securement, as well as electrical coupling between wire 27 and an internal surface of the hollow base 31, base 31 includes an open end 35. Cement 33 can simply be positioned through end 35 to a proper depth therein when envelope 11 is oriented in a suitable position (e.g., vertical). As clearly seen in FIGS. 1 and 2, the hollow base member does not directly engage (contact) the sealed end portion 15 of envelope 11. As especially seen in FIG. 2, only sealing cement 33 directly contacts the outer surfaces of the enclosed sealed end portion.

Electrical coupling between the conductive base and lead-in conductor 27 is accomplished using a relatively thin conductive (e.g., nickel) member 37 which, as illustrated, is of substantially curvilinear configuration. Accordingly, a first end of member 37 is connected (e.g., welded) to wire 27 and the opposing, second end is connected (e.g., welded) to the illustrated internal surface of base 31. It is also seen in FIG. 2 that the described Sauereisen cement substantially totally surrounds sealed end portion 15, as well as the defined conductive member 37. Connection between the base and conductor is preferably accomplished by firstly connecting member 37 to the illustrated internal surface of the base and thereafer positioning the base on the respective end of envelope 11. Connection of the remaining end of member 37 to wire 27 is then achieved, simply, through the open end of the base. The aforementioned sealing cement can then be added. A particularly advantageous feature of the invention as defined is the fact that base 31 need not be oriented in any specific manner of alignment relative to flattened end portion 15 prior to positioning thereover. This is a distinct advantage over prior art base designs such as illustrated in the aforementioned patents.

As stated, base 31 is electrically conductive. As illustrated in the drawings, base member 31 is also of substantially the same configuration (cylindrical) as the body portion 13 of envelope 11 to thus facilitate positioning thereon. In one embodiment, the hollow, cylindrical base possessed an internal diameter slightly greater than the corresponding outer diameter of body portion 14. Specifically, base 31 possessed an internal diameter of about 0.435 inch and a corresponding external diameter of about 0.500 inch, thus having a wall thickness of only about 0.032 inch. The corresponding outer diameter for body portion 13, when using a base of these dimensions was about 0.395 inch.

In one preferred example of the invention, base 31 was formed from a piece of seamless copper tubing. Such construction proved particularly effective in assuring sound electrical connection with the corresponding electrical contacts utilized in connectors (or sockets) in which lamp 10 was positioned. Such connection is of course deemed extremely important. In another embodiment of the invention, base 31 was formed of the described copper tubing and further included a relatively thin, outer conductive layer (e.g., nickel) thereon. The conductive layer was preferably applied by plating. This conductive outer layer is shown in phantom in FIG. 2 and represented by the numeral 39.

In one example of the invention, lamp 10 possessed an overall length of about 44.50 inches, with each of the opposingly positioned conductive bases 31 having an overall length of about 1.00 inch. The lamp's lighted length was approximately 38.80 inches. The lamp was operational at 120 VAC and produced a wattage of about 1450 watts. The approximate coil temperature was 2,660° Kelvin with the corresponding minimum bulb wall temperature of about 250° Celsius. Envelope 11 possessed an outer diameter of about 0.375 inch and had an overall length of about 43.85 inches. Such a lamp operated successfully within a photocopy machine as an infrared lamp.

It is to be understood that the invention is not limited to the above dimensions. For example, lamps produced in accordance with the teachings herein may operate at voltages within the range of from about 120 to about 570 volts, produce wattages within the range of from about 375 to about 6,000 watts, and have an envelope length ranging from about nine inches to about the aforementioned approximately 44-inch length. It is also understood that the invention is not limited to the above dual-ended examples in that the base as defined herein may also be used with a lamp possessing a singular sealed end portion.

Thus, there has been shown and described an electric lamp wherein a base is provided for substantially preventing breakage to the sealed end of the lamp. The base as defined substantially totally surrounds the sealed end as well as a part of the body portion of the lamp's envelope. Being of a sound conductive material and of seamless construction, the base also assures a positive connection between the lamp's filament and the respective connector or socket in which the base is positioned. The invention as defined is also of relatively simple construction, thereby facilitating assembly thereof while assuring a relatively inexpensive finished product.

While there have been shown and described what are at present considered the preferred embodiments of the invention, it will be obvious to those skilled in the art that various changes and modifications may be made therein without departing from the scope of the invention as defined by the appended claims.

What is claimed is:

1. In an electric lamp for providing radiant heat, said lamp including an envelope having an elongated, substantially cylindrically shaped body portion and at least one sealed end portion of flattened configuration located at one end of said body portion, a conductive filament located within said body portion, at least one lead-in conductor positioned within said sealed end portion and having a first end thereof projecting within said body portion and connected to said filament and a second end thereof projecting externally of said sealed end portion, and a base secured to said sealed end portion, the improvement wherein said base comprises:

an electrically conductive member of hollow configuration electrically coupled to said second end of said lead-in conductor, said base located substantially about said flattened sealed end portion and extending over and engaging at least a portion of said substantially cylindrically shaped body portion of said envelope having said conductive filament therein to substantially totally surround both said flattened sealed end portion and said portion of said cylindrically shaped body portion to thereby substantially prevent breakage of said sealed end portion, said hollow base only directly engaging said substantially cylindrically shaped body portion and not directly engaging said sealed end portion.

2. The improvement according to claim 1 wherein said base member is of substantially cylindrical configuration having an inner diameter greater than the outer diameter of said body portion of said envelope.

3. The improvement according to claim 2 wherein said base member is of seamless construction and includes an open end.

4. The improvement according to claim 1 further including a quantity of sealing cement located within said base member and surrounding said sealed end portion of said envelope.

5. The improvement according to claim 1 further including a conductive member having a first end electrically connected to said second end of said lead-in conductor and a second end electrically connected to said base member.

6. The improvement according to claim 5 wherein said conductive member is of curvilinear configuration.

7. The improvement according to claim 5 further including a quantity of sealing cement located within said base member and surrounding said sealed end portion of said envelope and said conductive member.

8. The improvement according to claim 5 wherein said conductive member is nickel.

9. The improvement according to claim 1 wherein the material for said base member is selected from the group consisting of copper, aluminum, steel and nickel.

10. The improvement according to claim 9 wherein said base member has an outer, electrically conductive layer thereon.

11. The improvement according to claim 10 wherein said base member is copper and said conductive layer is nickel.

12. The improvement according to claim 1 wherein said filament is tungsten, said lamp being an infrared lamp.

* * * * *